US005860532A

United States Patent [19]

Arvidson

[11] Patent Number: 5,860,532

[45] Date of Patent: Jan. 19, 1999

[54] MATERIAL SEPARATOR

[76] Inventor: Bo R. Arvidson, 825 Colorow Rd., Golden, Colo. 80401

[21] Appl. No.: 744,417

[22] Filed: Nov. 8, 1996

[51] Int. Cl.[6] ..... B03C 01/02

[52] U.S. Cl. ..... 209/212; 209/219

[58] Field of Search ..... 209/219, 221, 209/215, 231, 636, 212

[56] References Cited

U.S. PATENT DOCUMENTS

| | | | |
|---|---|---|---|
| 411,899 | 10/1889 | Moffott | 209/212 |
| 1,365,965 | 1/1921 | Buchanan . | |
| 1,414,170 | 4/1922 | Bethke et al. . | |
| 2,959,288 | 11/1960 | Fowler . | |
| 2,992,738 | 7/1961 | Maynard . | |
| 3,552,565 | 1/1971 | Fritz . | |
| 3,926,792 | 12/1975 | Buford . | |
| 5,057,210 | 10/1991 | Julius | 209/219 |
| 5,092,986 | 3/1992 | Feistner et al. | 209/212 |

FOREIGN PATENT DOCUMENTS

| | | | |
|---|---|---|---|
| 342330 | 11/1989 | European Pat. Off. | 209/219 |
| 974187 | 12/1960 | Germany | 209/219 |
| 4323932C1 | 7/1993 | Germany . | |
| 1294381A | 10/1985 | U.S.S.R. . | |

OTHER PUBLICATIONS

[* 974187 3 pages figs. only].

"Magnetic Separation and Materials Handling", by Elme, Box 24 S–343 21 Almhult, Sweden.

"Steinert Laborscheider", by Elektromagnetbau, Widdersdorfer StraBe 329–331, Postfach/PB/BP 451160; D–50–Koln 41.

*Primary Examiner*—Karen M. Young

*Assistant Examiner*—Gregory A. Morse

*Attorney, Agent, or Firm*—Timothy J. Martin; Michael R. Henson

[57] ABSTRACT

A material separator separates non-magnetic particulate material into components having differing electrical conductivities and comprises a support frame, a drum rotatably journaled with respect to the support frame, a magnetic assembly in the drum interior and a drive system. The drum's sidewall is cylindrically shaped and the magnetic assembly incudes longitudinally extending magnetic arrays, each angularly spaced from one another and rotatably journaled on a respective array axis that is radially spaced from the drum axis. The magnetic arrays include opposite magnetic poles located along a rotational surface such that when they rotate, an oscillating magnetic field is induced through the drum's sidewall. The drive system rotates the magnetic arrays and the drum so that particulate material placed on an outer surface of the drum sidewall is subjected to the oscillating magnetic field whereby components having different electrical conductivities are discharged with differing discharge trajectories. A methodology for separating non-magnetic particulate material is also provided.

39 Claims, 8 Drawing Sheets

MATERIAL SEPARATOR

FIELD OF INVENTION

The present invention is directed to material separators of a type which are adapted to separate particulate material into different components thereof based upon differing characteristics of the components. More specifically, the present invention concerns material separators having a magnetic assembly disposed interiorly of a drum so that, as non-magnetic particulate material is advanced by a sidewall surface of the drum, the material is subjected to a fluctuating magnetic field produced by the magnetic assembly and differing trajectories are imparted to the various components of the material based upon the electrical conductivities of the components.

BACKGROUND OF THE INVENTION

The ability to separate aggregate material into various components has proved highly valuable to modern industrial applications. Many different separation techniques have been utilized in the past with these techniques relying on differing characteristics of the components of the aggregate, such as size, weight, specific gravity, solubility of different solvents, etc. Metal recycling, waste handling, incineration and biofuel production represent only a few of the various industries for which magnetic separation and materials handling is needed. Depending upon the particular application, material separators may be used either individually or collectively for the purpose of separating particulate material into desired components.

It has long been recognized in certain industries, such as the paper industry and the glass recycling industry, that the separation of non-magnetic particulate material into metallic and non-metallic components based on electrical conductivities has particular utility. One type of apparatus which has been used for the purpose of separating out non-magnetic metals is known as an eddy-current separator. Eddy-current separators operate under the principle that electric current is induced within the body of a conductor when that conductor either moves through a non-uniform magnetic field or is in a region where there is a change in magnetic flux. Accordingly, eddy-current separators make it possible to separate metallic non-magnetic metals, such as aluminum, copper, zinc and magnesium, from non-metallic material, such as glass, plastic and rubber.

One type of eddy-current separator which has been used incorporates a rotating drum with an internal and independently rotatable magnetic roll to separate a mixed conglomerate of non-magnetic particulate material into these metallic and non-metallic components. More particularly, both the drum and its internal magnetic roll are journaled for rotation in a common direction about respective longitudinal axles and independently driven by separate motors. Housed within the internal magnetic roll is an array of elongated, rare earth magnets, such as neodymium. These permanent magnets are angularly spaced apart from the magnetic roll's axis and are polarized in a radial direction such that circumjacent ones of these permanent magnets have opposite poles located radially inwardly. The magnetic roll is positioned with its axle radially offset relative to the drum's axle so that the magnetic roll is positioned to have an active surface located proximate to the drum's sidewall. Further, the magnetic roll rotates at a rotational speed of approximately 400–600 revolutions per minute (rpm), or sometimes higher, to produce an oscillating magnetic field in a region therearound.

In operation, then, mixed material is introduced onto the drum's sidewall via a feeding system. As the material is fed onto the drum's sidewall, it is subjected to the oscillating magnetic field produced by the internal magnetic roll. This results in the induction of eddy-currents in those components of the particulate material which are conductive. The conductive materials are thrown in the same direction of the external drum's movement to a first location which may be either a first conveyor positioned beneath the drum or a discharge bin. Non-conductive materials are unaffected, and less conductive materials are less affected, by the oscillating magnetic field and follow the rotation of the external drum to be deposited at a second discharge location which may be a second conveyor positioned underneath the drum.

While this type of eddy-current material separator has proved useful in various industries for the purpose of separating non-magnetic material into metallic and non-metallic components, there are drawbacks in the construction of the apparatus. For example, the relatively slow angular velocity of the internal magnetic roll, coupled with the relative large mass of the permanent magnets housed therein, makes it rather difficult to produce a magnetic field which is strong enough to extend beyond the drum's sidewall and induce a sufficient amount of eddy-currents into the metallic components of the particulate material. In addition, the physical arrangement in some of these prior art eddy-current material separators is undesirable in that the permanent magnets are not distributed evenly around the internal magnetic roll which can result in balancing problems of the magnetic roll at certain angular velocities. Accordingly, the ability of these separators to efficiently separate the particulate material into desired components can be hindered.

It would, thus, be advantageous to provide a material separator, and specifically an eddy-current material separator, which has improved performance characteristics in the separation of non-magnetic particulate material. These improved characteristics can be accomplished, at least in part, by providing a magnetic roll assembly having a plurality of internal magnetic arrays, with each of the magnetic arrays rotating at a much higher angular velocity relative to the external drum to produce a superior oscillating magnetic field in the vicinity of the drum's outer sidewall surface. The present invention is directed to meeting this need, among others.

SUMMARY OF INVENTION

It is an object of the present invention to provide a new and useful material separator which is adapted to separate particulate material into various components depending on electrical conductivities of the components.

Another object of the present invention is to provide a material separator having an enhanced magnetic field strength.

A further object of the present invention is to provide a new and improved magnetic roll assembly which operates to produce a very high frequency fluctuating magnetic field in a material separator in order to separate non-magnetic particulate material into metallic and non-metallic components.

Yet another object of the present invention is to provide an eddy-current material separator having a selectively and rotatably adjustable magnetic assembly.

Still a further object of the present invention to provide a new and useful methodology for separating non-magnetic particulate material into different components based upon their differing electrical conductivities.

In accordance with these objectives, then, a material separator is provided which is adapted to separate nonmagnetic particulate material into different components having differing electrical conductivities. The material separator comprises a support frame and a drum rotatably journaled with respect to the support frame about a longitudinally extending drum axis. The drum has a drum sidewall formed as a cylindrical shell and a drum interior. A magnetic assembly is disposed in the drum interior and this magnetic assembly includes a plurality of longitudinally extending magnetic arrays each rotatably journaled on a respective longitudinally extending array axis that is radially spaced from the drum axis. Each of the magnetic arrays includes opposite magnetic poles located along a surface of rotation such that, as each of the magnetic arrays is rotated, opposite magnetic poles are sequentially advanced in closely spaced relation along the drum's sidewall thereby to induce an oscillating magnetic field through the sidewall.

The material separator also includes a drive system that operates to rotate each of the magnetic arrays about its respective array axis thereby to induce the oscillating magnetic field. This drive system further operates to rotate the drum about the drum axis so that, as the drum sidewall moves past the magnetic assembly, particulate material placed on an outer surface of the drum sidewall is subjected to the oscillating magnetic field whereby components of the particulate material having different electrical conductivities are discharged at different trajectories. The drive system may include either one or two drive motors for this purpose.

Preferably, each of the magnetic arrays is formed as a roll including a plurality of magnetic bars. These rolls may be positioned at a common radial distance from the drum axis and equiangularly spaced apart from one another relative thereto. Each of the rolls includes an outer cylindrical casing constructed of a non-magnetic material, with the magnetic bars housed within this casing. The magnetic bars associated with each roll are arranged in a plurality of longitudinally extending columns and are preferably equiangularly spaced apart from one another relative to the respective array axis. The columns, which may be formed by a plurality of discrete magnets arranged stack-wise in the longitudinal direction, have north and south poles aligned along a radial direction with adjacent ones of the columns having opposite poles located radially inwardly. It is preferred that the columns are separated from one another by a nonmagnetic spacer that is sized and adapted to be inserted into the roll's cylindrical casing.

The magnetic assembly may comprise three such rolls with a middle one of the rolls operative to counter-rotate with respect to outer ones of these rolls. Alteratively, two rolls may be employed which counter-rotate with respect to each other. Further, the drum axis includes an axle member disposed therealong and the magnetic assembly is supported relative to the axle member by an opposed pair of longitudinally spaced apart support plates. These support plates extend radially outwardly from the drum axle and each of the magnetic arrays is mounted between the support plates by a pair of flange bearings. Further, a key structure may be included to fixedly support the magnetic assembly relative to the axle member.

The drive system of the material separator is operative to rotate the magnetic arrays at a greater rotational speed, approximately 3,000 to 6,000 revolutions per minute, than the drum which typically rotates in a range of 60 to 120 revolutions per minute. Each of the rolls of the magnetic assembly includes a trunnion axle disposed along its roll axis, and the drive system may include a plurality of interlocking gears, with at least one such gear associated with each of the rolls and journaled about its respective trunnion axle, so that the rolls are coupled for rotation by these interlocking gears. Alternatively, only one driven roll may be used with rotation imparted to the others due to magnetic field interaction.

The outer surface of the drum's shell may have a medial portion with a reduced circumference relative to the remainder of the outer surface thereby to form a central working region for receiving particulate material. It is also preferred that the support frame be formed to include a collection bin that is positioned to receive the components of the particulate material as they are discharged or to allow space for a conveying system. This collection bin is preferably separated into two or more collection regions by a selectively positionable partition wall mounted to the frame.

The present invention also provides a material separator as described above in which the magnetic assembly is selectively and rotatably adjustable in position relative to the drum axis so that the high frequency magnetic field may be shifted to a desired location within the drum's interior. Along these lines, the magnetic assembly is fixedly mounted to the drum's axle and a handle member is releasably connected to a longitudinal end of this axle. The handle member is selectively movable with respect to the support frame thereby to reposition the magnetic assembly at discrete orientations within the drum interior. It is preferred that a bracket be mounted to the support frame and include adjustment holes or slots formed therethrough to permit positioning of the magnetic assembly.

The present invention is also directed to a method of separating non-magnetic particulate material into different components having differing electrical conductivities. Broadly, this methodology comprises the steps of rotating a drum about a longitudinally extending drum axis, producing a high frequency, oscillating magnetic field within an interior of the drum in a region proximate to the drum's sidewall, depositing the particulate material onto the drum's sidewall so that the material is subjected to the fluctuating magnetic field whereby components of the particulate material having different conductivities will be discharged off the drum with differing discharge trajectories, and thereafter collecting these components at separate discharge locations.

It is preferred that the steps of rotating the drum and producing the oscillating magnetic field occur simultaneously and that the step of producing the oscillating magnetic field is accomplished by rotating a plurality of magnetic rolls within the drum interior proximate to the drum sidewall. Further, it is preferred that at least two of the rolls are counter-rotated with respect to one another and that each of the rolls rotates at a greater rotational speed than the drum.

These and other objects of the present invention will become more readily appreciated and understood from a consideration of the following detailed description of the exemplary embodiments of the present invention when taken together with the accompanying drawings, in which:

BRIEF DESCRIPTION OF DRAWINGS

FIG. 11(*b*) is a side view illustrating the relative rotation and orientation of the magnetic arrays according to the first exemplary embodiment of the present invention, with the arrays shown in a second orientation;

FIG. 11(*c*) illustrates an alternative orientation for the magnetic arrays according to the first exemplary embodiment of the present invention;

DETAILED DESCRIPTION OF THE EXEMPLARY EMBODIMENTS

The present invention is directed to a material separator which is useful in the separation of non-magnetic particulate material into different components which have differing electrical conductivities. This invention may be used with either dry material, wet material or slurried material where components of differing electrical conductivities are present. From the ensuing description, it should be appreciated that the material separator of the present invention may be used as either a stand alone apparatus or as a component of a larger conveyor system which operates to further separate aggregate material into various components based on properties such as size, weight, specific gravity, etc.

Figure 1:
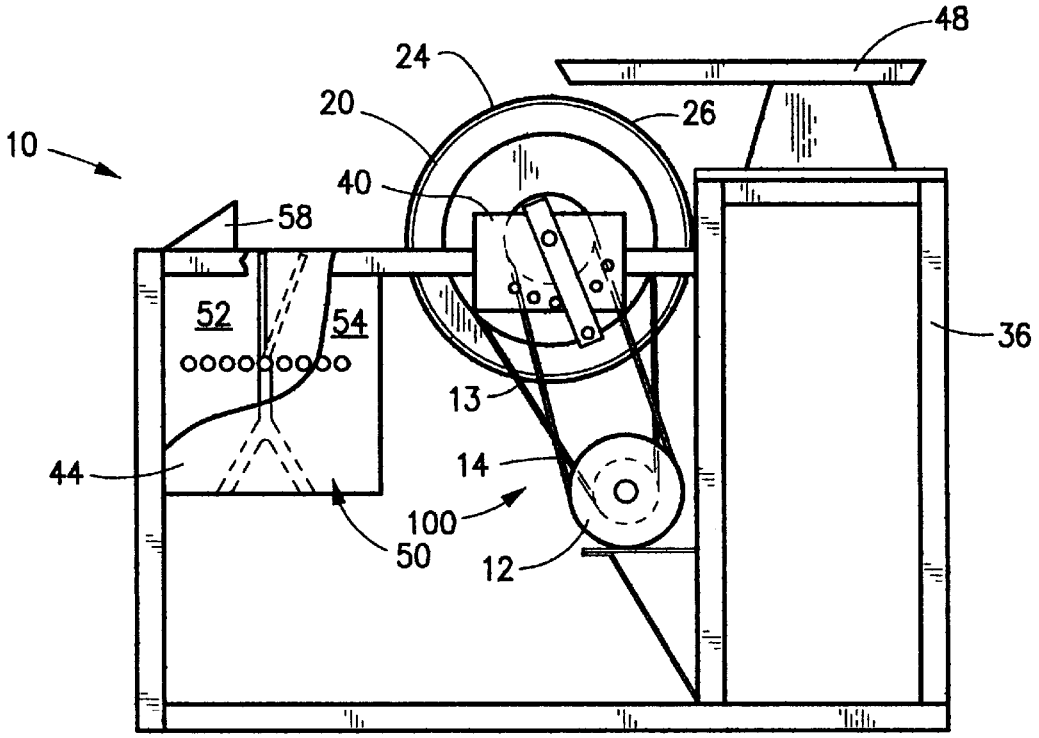
FIG. 1 is a side view in elevation of a material separator according to the first exemplary embodiment of the present invention.
Figure 2:
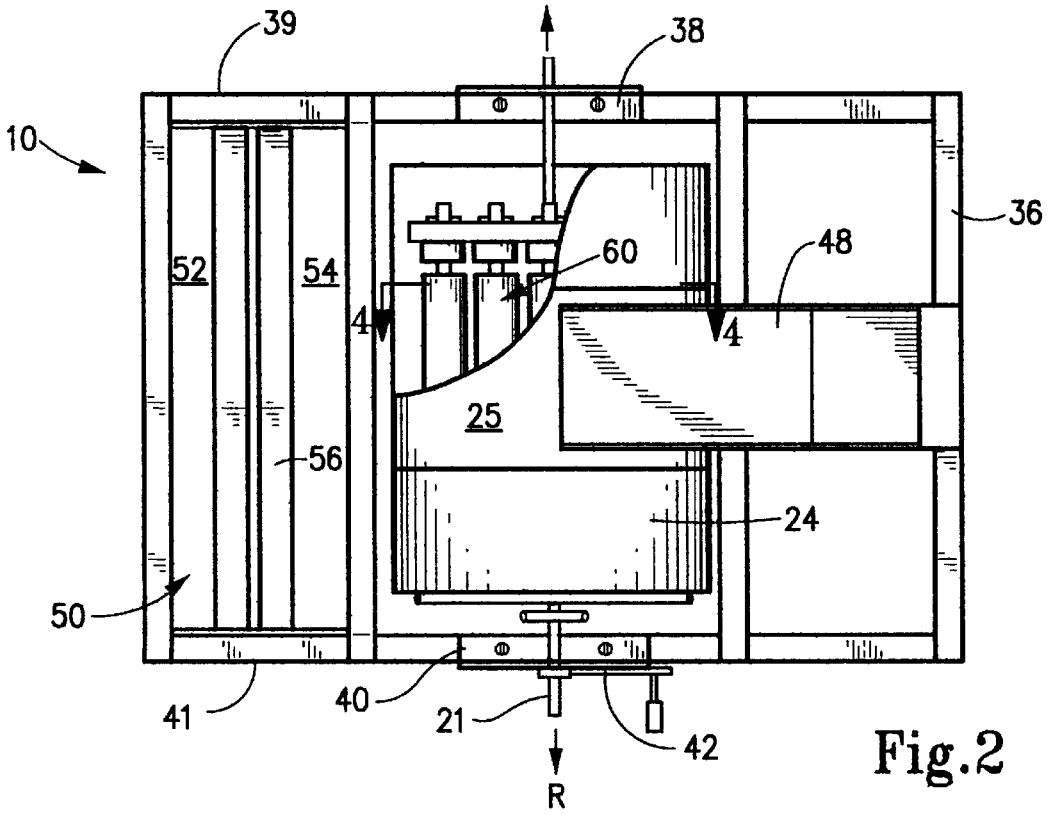
FIG. 2 is a top plan view of the material separator shown in FIG. 1.

With reference first to FIGS. 1 and 2, it may be seen that material separator 10 includes a drum 20 rotatably journaled about a drum axis "R". An electrical drive motor 12 acts through a drive system 100 to impart rotation to drum 20. Drum 20 is rotatably journaled with respect to a support frame 36 with drum axis "R" preferably oriented horizontally. The drum's axle 22 is mounted relative to support frame 36 by a pair of spaced apart mounting brackets 38,40.

Drum 20 has a drum sidewall 26 formed as a cylindrical shell and particulate material may be introduced onto the outer surface 24 of drum 20 at an upper location, for example, by means of feed tray 48. The particulate material is thereafter cast into a collection bin 50 located at a downstream location from drum 20.

A magnetic assembly 60 is disposed within an interior 28 of drum 20 and operates, upon actuation by electrical drive motor 12, to produce a very high frequency oscillating magnetic field which penetrates drum sidewall 26 so that eddy-currents are induced in conductive components of the particulate material. The conductive components subjected to this magnetic field are then discharged into a first distal region 52 of collection bin 50. In contrast, non-conductive components of the particulate material are unaffected by this high frequency magnetic field and fall into a second, nearer region 54 of collection bin 50 due simply to the force of gravity. Accordingly, the present invention proves quite useful for the separation of non-magnetic, conductive material from an aggregate.

The drum's sidewall 26 may be formed out of a plastic material and the outer surface 24 of its shell preferably has a medial portion 25 with a reduced circumference with respect to a remainder of the outer surface 24 to provide a central working region for receiving the particulate material. For the material separator according to this first exemplary embodiment, the drum's shell has a diameter of approximately 30" (760 mm), of course other sizes are certainly contemplated.

Figure 3:
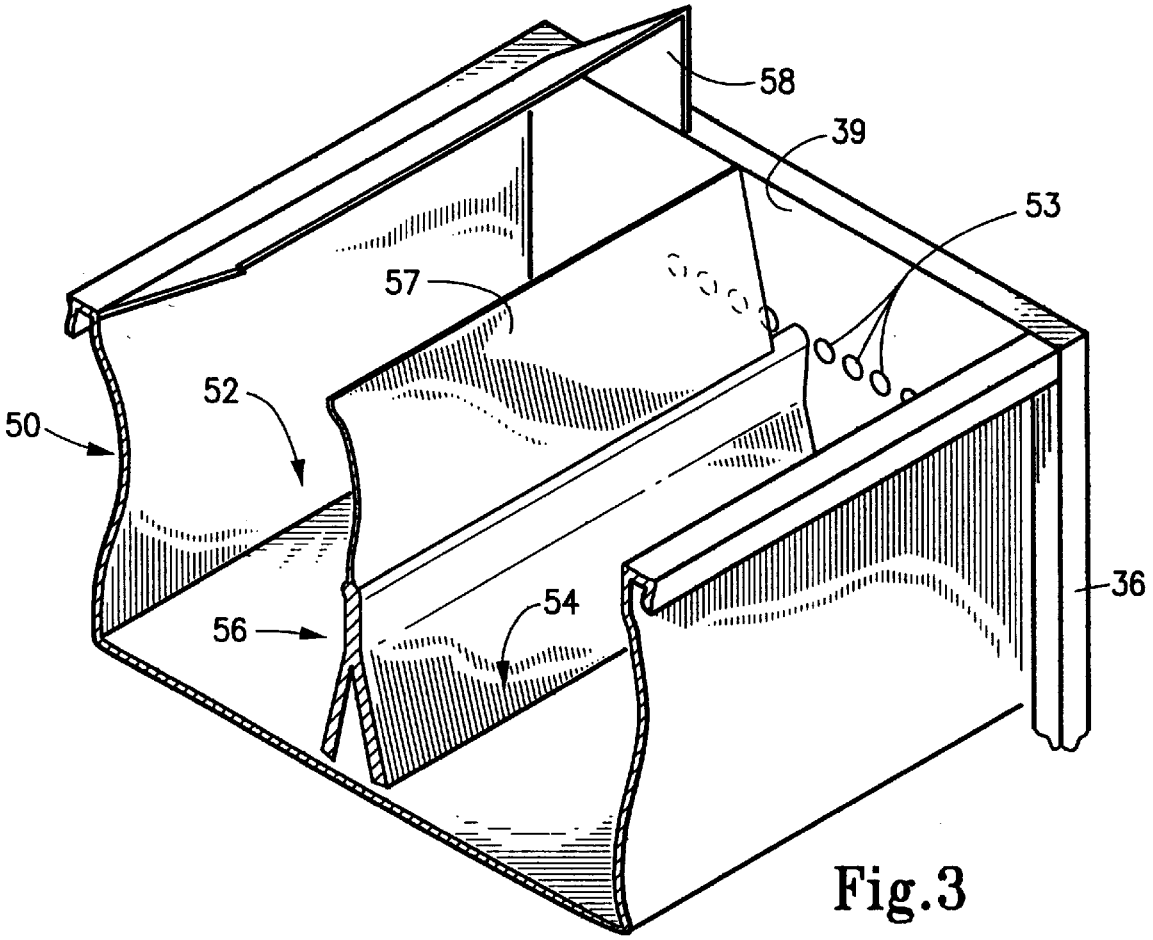
FIG. 3 is a perspective view in partial cross-section showing a preferred construction for the collection bin located at a downstream end of the material separator depicted in FIGS. 1 and 2.

The construction of collection bin 50 is best shown with reference to FIG. 3 wherein it is seen that collection bin 50 is separated into first region 52 and second region 54 by a partition wall 56. Partition wall 56 is selectively positionable within collection bin 50 to vary the relative sizes of first and second regions 52, 54. With reference to FIGS. 1 and 3, a plurality of opposed positioning holes 53 are formed within opposite sides 39 and 41 of bin 50 so that partition wall 56 may be selectively positioned to extend into opposed ones of these holes 53. In addition, partition wall 56 preferably includes a selectively tiltable flap 57 and collection bin 50 preferably includes a downstream guard 58 to better direct discharged components into distal region 52. Of course, other constructions for collection bin 50 that provide adjustability are certainly contemplated. For example, slots could be employed in place of holes 53.

Figure 4:
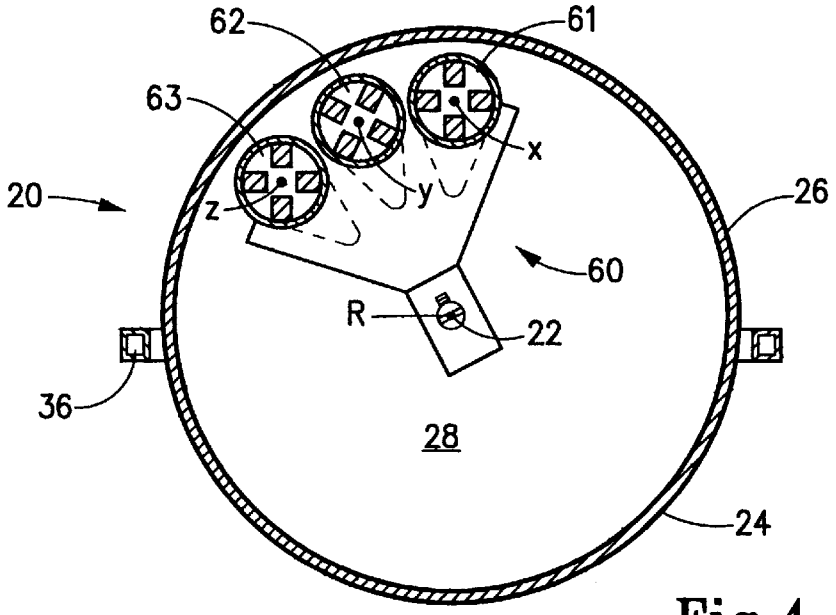
FIG. 4 is a cross-sectional view taken about lines 4—4 of FIG. 2.
Figure 7:
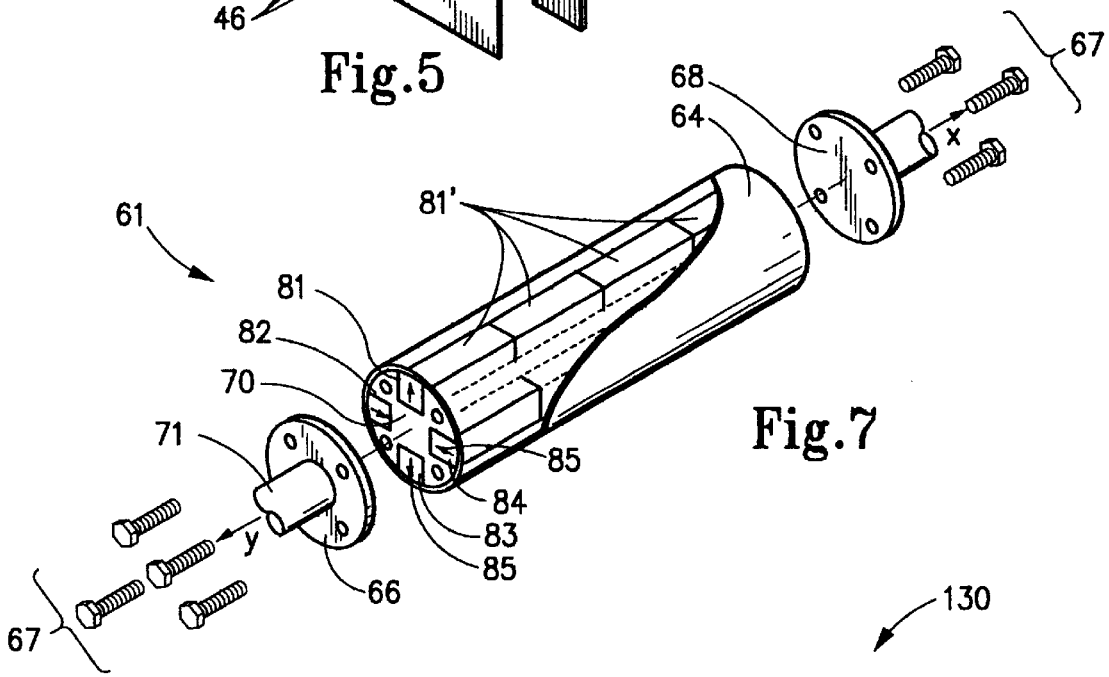
FIG. 7 is an exploded perspective view showing an exemplary construction for a representative one of the magnetic arrays of the magnetic assembly shown in FIG. 6.
Figure 6:
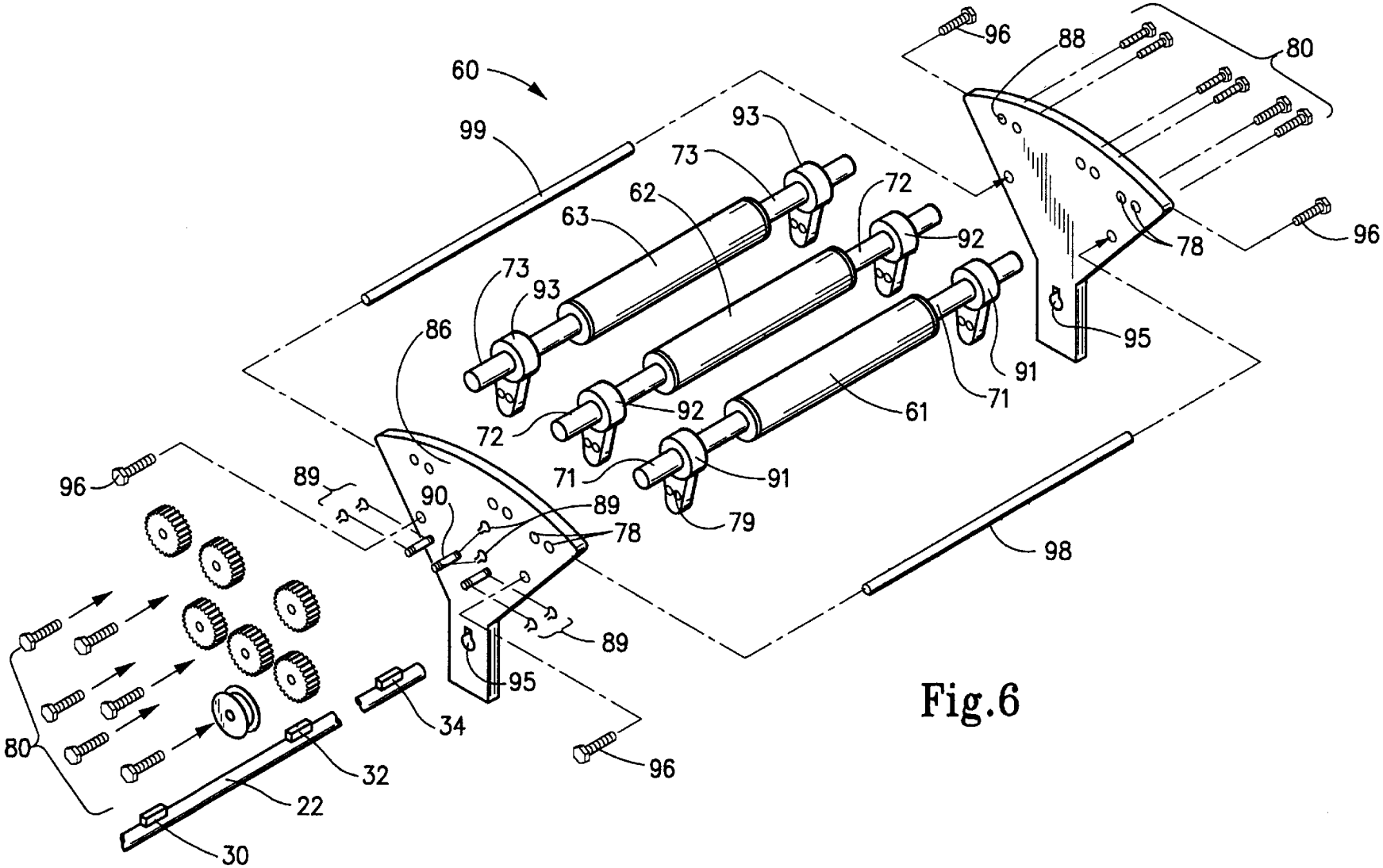
FIG. 6 is an exploded perspective view showing an exemplary construction for the magnetic assembly according to the first exemplary embodiment of the present invention.

Magnetic assembly 60, the construction of which will be discussed in greater detail below with reference to FIGS. 6 and 7, is formed by a plurality of longitudinally extending magnetic arrays 61–63, which are each rotatably journaled on a respective longitudinally extending array axis, "x", "y" and "z", as shown in FIG. 4. These array axes are radially spaced from drum axis "R" and are angularly spaced from one another relative to drum axis "R". Each of magnetic arrays 61–63 includes alternating north and south magnetic poles located along a surface of rotation so that, as each of the arrays is rotated, opposite magnetic poles are sequentially advanced in closely spaced relation alongside drum sidewall 26 thereby generating the high frequency magnetic field therethrough.

Figure 5:
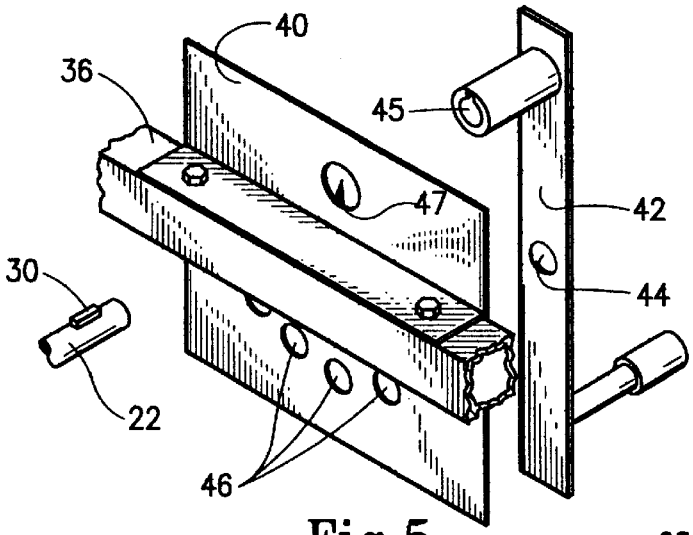
FIG. 5 is an exploded perspective view, in partial cross-section, showing a preferred construction for the handle member which is employed to adjust position of the material separator's internal magnetic assembly.

Magnetic assembly 60 is fixably mounted to drum axle 22 and is selectively and rotatably adjustable in position relative to drum axis "R" so that the magnetic field may be shifted to a desired location within drum interior 28. To this end, a handle member may be employed to engage the drum axle and to rotate the magnetic assembly 60 within drum interior 28. As shown in FIG. 5 drum axle 22 extends through an aperture 47 formed in mounting bracket 40 and a longitudinal end portion of drum axle 22 is provided with a key structure 30. Key structure 30 is sized for insertion into a cooperatively configured keyway slot 45 formed in a handle 42 so that rotational manipulation of handle 42 imparts a corresponding rotation to drum axle 22 and magnetic assembly 60. A nub 44 is formed on handle 42 and this nub 44 is adapted for insertion into a selected one of adjustment holes 46 in mounting bracket 40 thereby to retain drum axle 22 and magnetic assembly 60 at a fixed orientation within drum interior 28.

The particular construction for magnetic assembly 60 is best understood with reference to FIGS. 6 and 7. Each of magnetic arrays 61–63, which are preferably in the form of cylindrical rolls as shown, has an associated trunnion axle 71–73, respectively, which projects from opposite ends of the array. Trunnion axles 71–73 are respectively received through, and rotatable within, opposed pairs of flanged bearings 91–93. A pair of longitudinally spaced apart and arcuately configured support plates 86 and 88 are provided and these support plates 86, 88 have a plurality of mounting holes 78 which are alignable with corresponding mounting holes 79 formed in flanged bearings 91–93 so that flanged bearings 91–93 may be mounted to support plates 86 and 88 via mounting fasteners 80. Each of support plates 86 and 88 is further provided with a keyway 95 through which corresponding second and third key structures 32 and 34 formed on drum axle 22 are respectively received, thereby to fixedly support the magnetic assembly 60 relative to drum axle 22. A pair or longitudinally extending spacer bars 98,99 may also be mounted between support plates 86 and 88, via fasteners 96, to provide added rigidity to the construction of magnetic assembly 60. Of course, other constructions, such as rectangular plates, may be employed in place of spacer bars to provide for added rigidity.

A preferred construction for a representative one of the magnetic arrays is shown in FIG. 7 wherein it may be seen that magnetic array 61 is formed as a cylindrical roll that is rotatably journaled on longitudinally extending array axis "x". Roll 61 includes a plurality of magnetic bars organized in a plurality of columns, such as columns 81–84. These columns 81–84 are preferably equiangularly spaced apart from one another relative to array axis "x" and each may be formed by a plurality of discrete magnets arranged stackwise in the longitudinal direction. Thus, for example, representative column 81 might include four such discrete magnets 81'.

The organization of the magnetic bars provides a superior magnetic field for material separator 10 as rolls 61–63 are rotated. To this end, each magnetic bar is a high field strength ferromagnetic element. It should be understood, however, that other magnets such as rare-earth magnets and the like could also be employed depending on the field strength desired. The present invention utilizes ferromagnetic bars measuring approximately 0.75 inches by 0.96 inches in cross-section, but the ordinarily skilled person in this field would also appreciate that the profile, shape and number of bars could be varied to achieve a desired magnetic field strength without departing from the scope of this invention.

Arrows 85 in FIG. 7 show the direction of the magnetic poles of the magnetic bars in columns 81–84, with the head of arrows 85 indicating a magnetic north. It may also be seen that these magnetic bars have magnetic poles that are oriented perpendicularly to the radial direction with circumjacent ones of the magnetic bars having oppositely oriented polarities. Thus, opposite magnetic poles are located radially inwardly so that as magnetic array 61 is rotated, opposite magnetic poles are sequentially advanced along a surface of rotation that is alongside the drum's sidewall, thereby to induce an oscillating magnetic field through the drum's sidewall.

Columns 81–84 are separated from one another by a non-magnetic spacer 70 which may be formed from a high density polyethylene material. Magnetic array 61 has an outer roll casing 64 constructed of a nonmagnetic material, such as stainless steel, and columns 81–84 and spacer 70 are insertable into this outer casing 64. Magnetic array 61 also includes a pair of end caps 66 and 68 that enclose opposite ends of casing 64. End caps 66 and 68 are securable to spacer 70 by fastening screws 67. It may be seen that the first magnetic array's trunnion axle 71 is welded to and projects from these end caps 66, 68.

Figure 8:
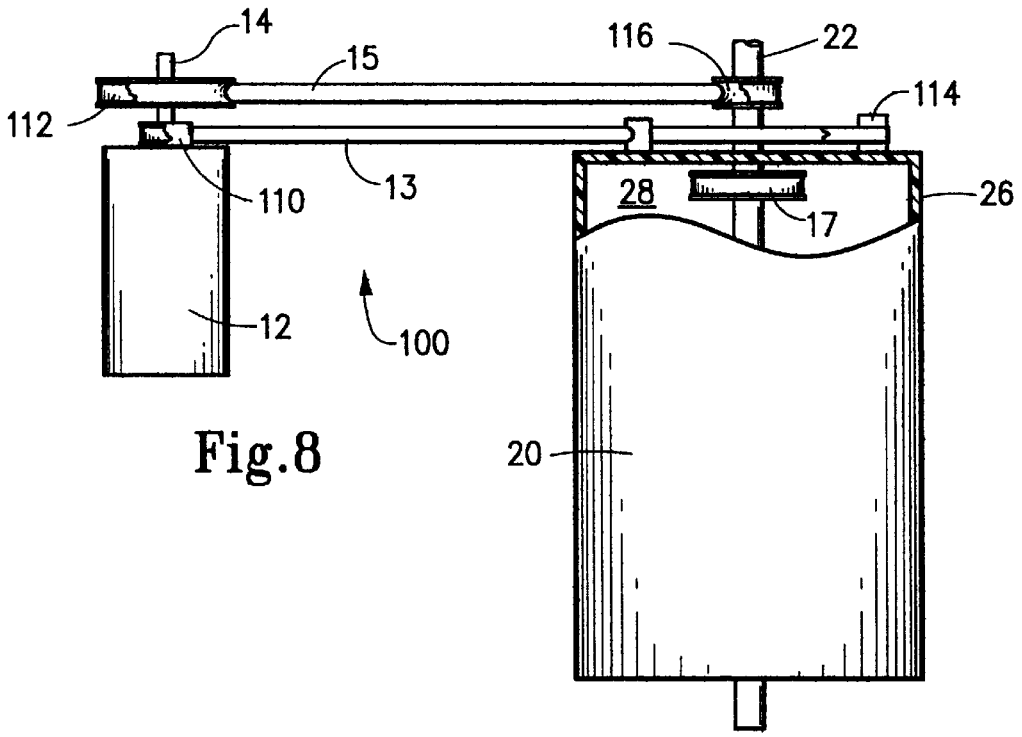
FIG. 8 is a top plan view of the drive system for the material separator according the first exemplary embodiment of the present invention.

As discussed above, drive system 100 is operative both to rotate the magnetic arrays 61–63 about their respective array axis to induce the oscillating magnetic field and to rotate drum 20 about drum axis "R" so that, as the drum sidewall 26 moves past magnetic assembly 60, particulate material placed on the drum's outer surface 24 is subjected to the oscillating magnetic field whereby components of the particulate material having different electrical conductivities will be discharged off of drum 20 with differing discharge trajectories. In accordance with this, then, a first exemplary construction for drive system 100 may be seen now with reference to FIGS. 8–10. In order to rotate drum 20 about its axle 22, drive motor 12 is provided with an inboard motor pulley 110 and this inboard motor pulley 110 is coupled, via a first drive belt 13, to a larger inboard drum pulley 114 that is disposed about the drum axle 22 exteriorly of drum sidewall 26. Inboard drum pulley 114 is interconnected to the drum's sidewall 26. Drum sidewall 26 is supported by bearing 121 which allows sidewall 26 to turn independently of drive system 116, 118 and 125 and drum axle 22. Thus, rotation of inboard motor pulley 110 imparts a simultaneous but slower rotation to the larger inboard drum pulley 114 which in turn causes the drum's sidewall 26 to rotate about drive axle 22 at a selected rotational speed. It is preferred that this rotational speed be approximately 30 to 200 revolutions per minute (rpm), and with a shell diameter of approximately 30 inches (760 mm), it has been found that a 5 HP motor provides sufficient torque.

Figure 9:
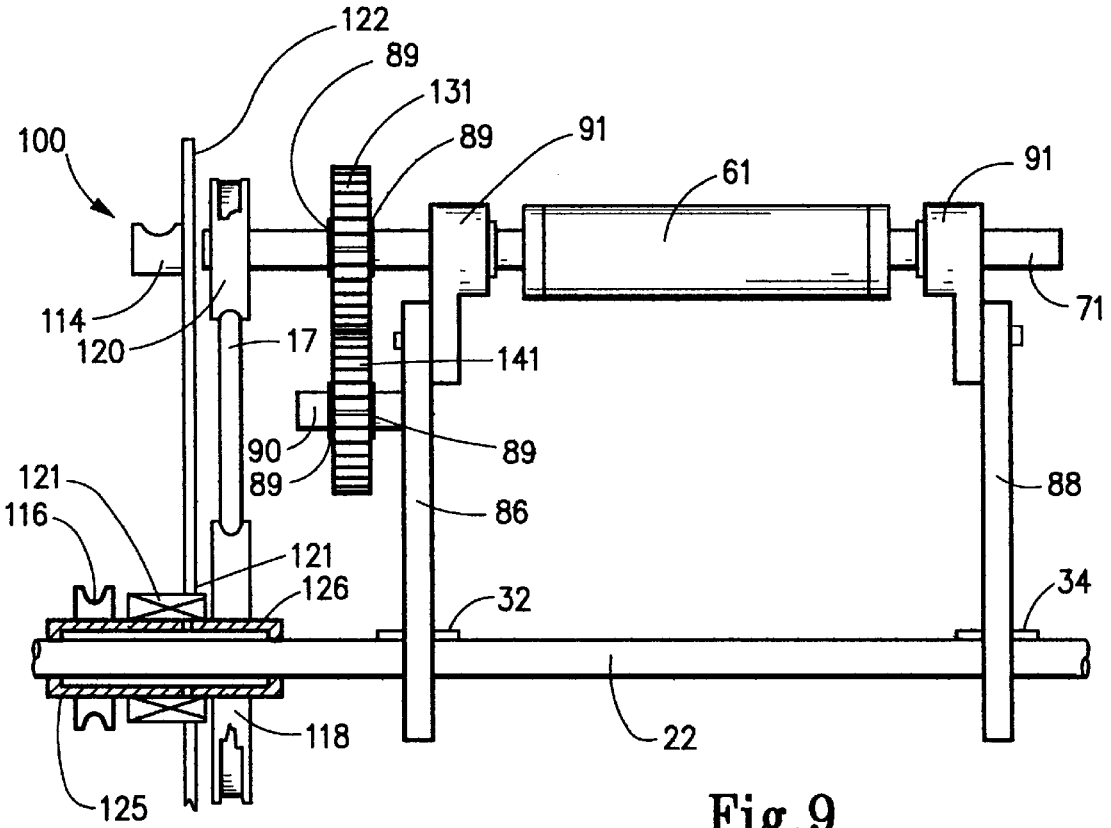
FIG. 9 is an end view in elevation showing a preferred construction for the drive system according to the first exemplary embodiment of the present invention.

In order to rotate each of the rolls associated with magnetic assembly 60, a larger outboard motor pulley 112 is associated with drive motor 12 and this outboard motor pulley 112 is coupled for rotation, via a second drive belt 15, to a smaller outboard drum pulley 116. As shown in FIG. 9, outboard drum pulley 116 is interconnected by a sleeve 125 to a first interior drum pulley 118 and both of these members are rotatably supported by bearings 126 on stationary drum axle 22. First interior drum pulley 118 is coupled for rotation, via a third drive belt 17, to a smaller interior drum pulley 120 located thereabove. This smaller interior drum pulley 120 is disposed about and fixed for rotation with first trunnion axle 71 associated with first magnetic array 61. Thus, it may be appreciated that rotation of outboard motor pulley 112 imparts simultaneous rotation to both the smaller outboard drum pulley 116 and first interior drum pulley 118, which in turn imparts simultaneous rotation to magnetic array 61 via second interior drum pulley 120.

Figure 10:
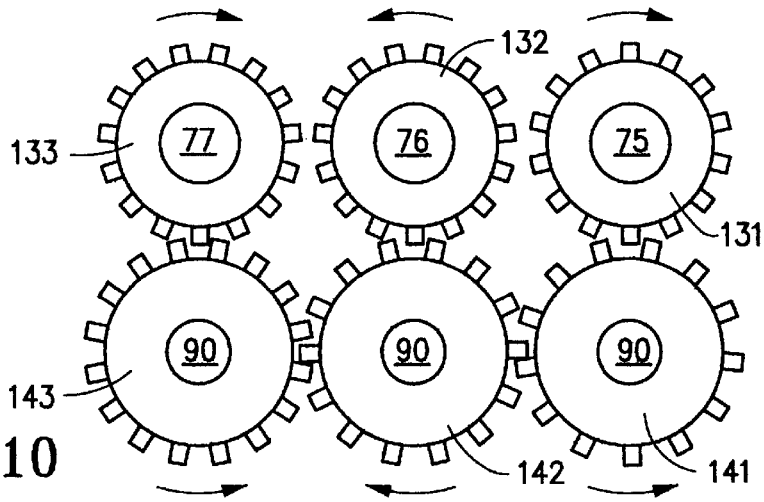
FIG. 10 is a side view illustrating the orientation of the interlocking gear assembly for the material separator according to the first exemplary embodiment of the present invention.

Drive system 100 may also include an interlocking gear assembly 130, as best seen in FIG. 10, so that rotation of first magnetic array 61 results in a similar rotation to magnetic arrays 62 and 63. To explain, it may be seen that each of rolls 61–63 has an upper roll gear fixedly disposed about its respective trunnion axle. Thus, an upper first roll gear 131 is associated with first roll 61, an upper second roll gear 132 is associated with second roll 62 and an upper third roll gear 133 is associated with third roll 63. Each of upper roll gears 131–133 has an associated lower roll gear that is rotatable about a post 90 which projects from and is welded to support plate 86 as shown in FIG. 6. Thus, a lower first roll gear 141 is associated with first roll 61, a lower second roll gear 142 is associated with second roll 62 and a lower third roll gear 143 is associated with third roll 63. Each upper roll gear is in interlocking engagement with its associated lower roll gear and adjacent ones of the lower roll gears 141–143 are also in interlocking engagement with one another so that rotation of upper first roll gear 131 in a clockwise direction imparts a clockwise rotation to first roll 61, which in turn imparts a counterclockwise rotation to second roll 62 and a clockwise rotation to a third roll 63. Accordingly, second roll 62 counterrotates with respect to first roll 61 and third roll 63 and each of rolls 61–63 rotates at a common rotational speed.

It is desired that the magnetic field generated by the magnetic assembly 60 have a frequency in the range of 6,000 to 12,000 Hz so that each of magnetic arrays 61–63 spins at a rotational speed of approximately 3,000 to 6,000 revolutions per minute (rpm), or roughly 50 times faster than the rotational speed of drum 20. Moreover, it is preferable that at least one of rolls 61–63, namely middle roll 62, counterrotate with respect to the other two rolls because this counterrotation enhances induction of eddy-currents in the particulate material as they are subjected to the high frequency magnetic field. Of course, the ordinarily skill artisan in this field would appreciate that separation of non-magnetic, conductive components in a particulate material could be accomplished with the use of fewer than three rolls. Thus, while one small roll would work, two rolls would result in better separation because counterrotation can offset the particle rotation that may be created as a result of the alternating magnetic fields. For larger diameter shells (30") it is believed that optimum results are achievable where three rolls are incorporated as described herein, because this permits improved separation for smaller components in the particulate material.

Figure 11A:
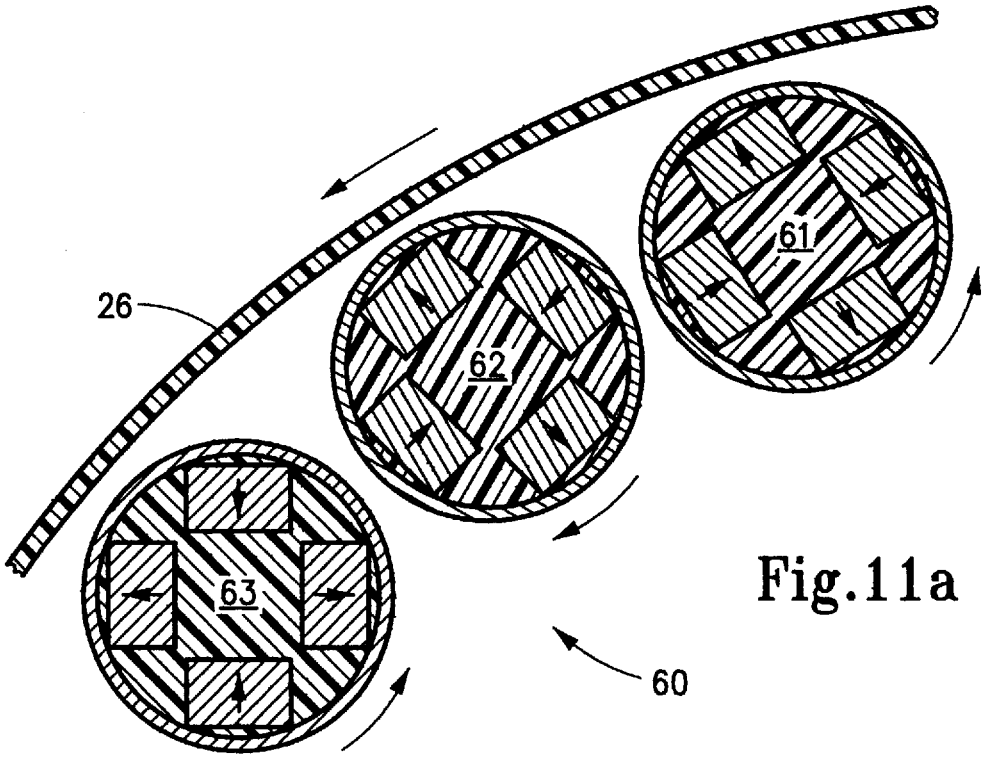
FIG. 11(*a*) is a side view illustrating the relative rotation and orientation of the magnetic arrays according to the first exemplary embodiment of the present invention, with the arrays shown in a first orientation.
Figure 11B:
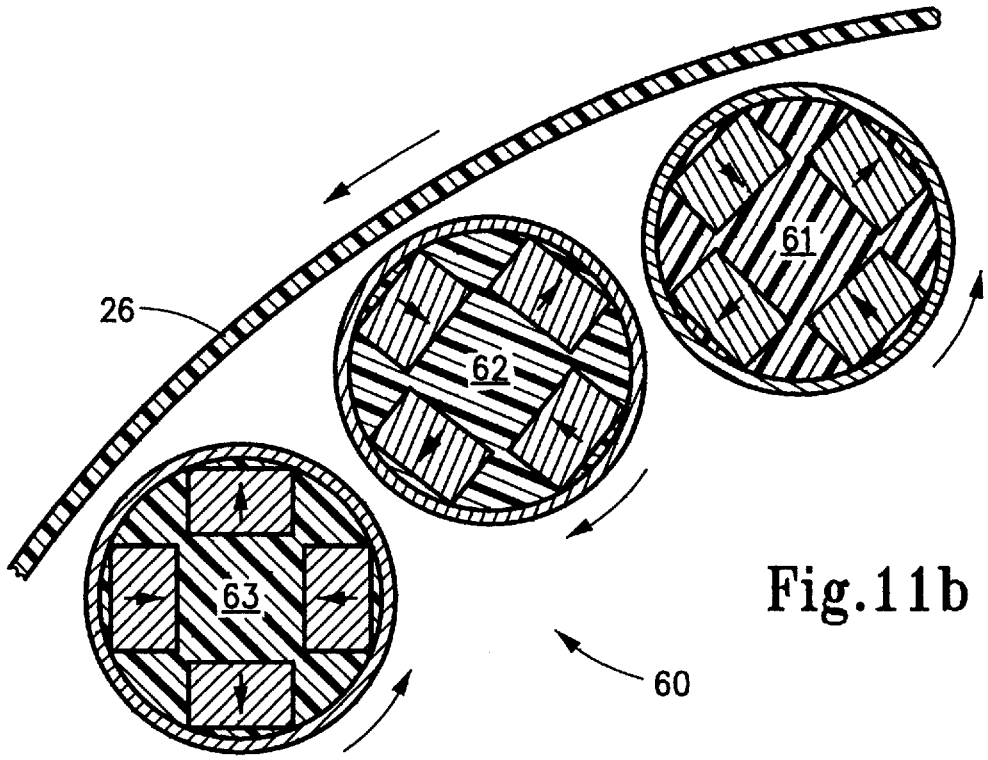
Figure 11C:
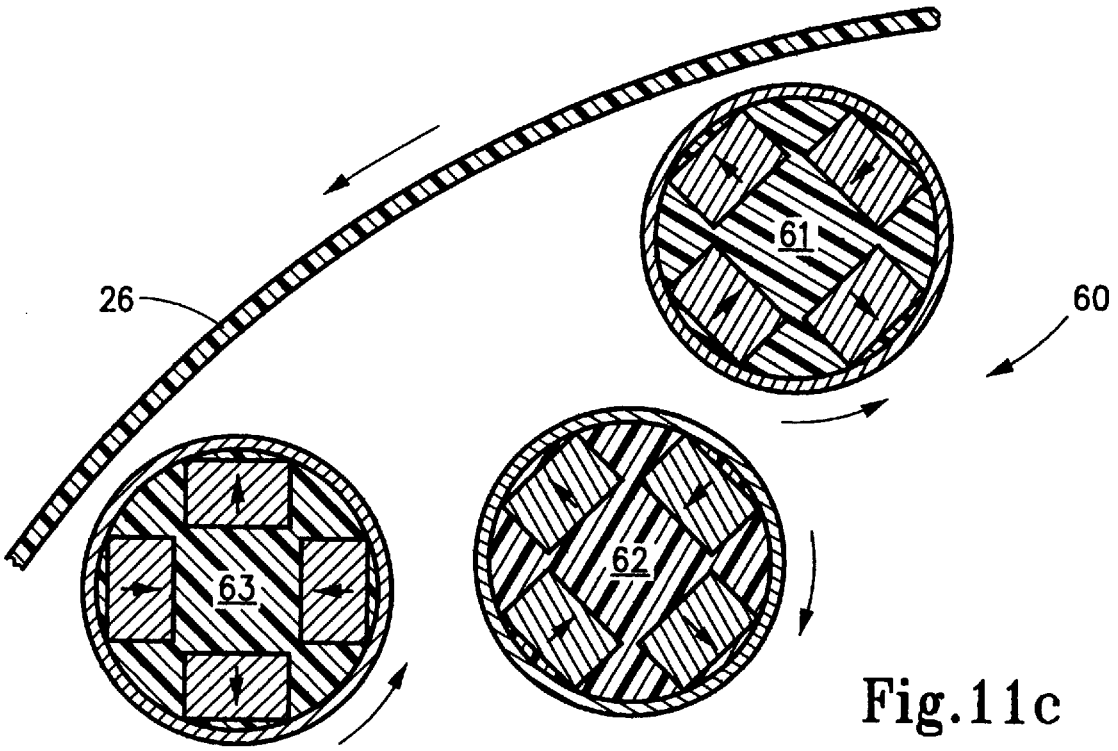

With the foregoing description in mind, the operation of material separator 10 and the fluctuating magnetic field generated by its internal magnetic assembly 60 may be best appreciated now with reference to FIGS. 11(*a*) and 11(*b*). As discussed earlier, circumjacent ones of the magnetic bars associated with each of magnetic arrays 61–63 have oppositely oriented polarities so that, as the arrays are rotated, opposite magnetic poles are sequentially advanced alongside the drum's sidewall 26, thereby to induce an oscillating magnetic field therethrough. Moreover, as shown in FIGS. 11(*a*) and 11(*b*), it may be advantageous that adjacent ones of magnetic arrays 61–63 are orientated so that adjacent magnetic fields are 45 degrees (45°) out of phase relative to one another. The primary reason that the arrays 61–63 are offset 45 degrees (45°) is to reduce the amount of torque required for drive motor 12 to rotate arrays 61–63. The rotational speed of the arrays, 3,000 to 6,000 revolutions per minute (rpm), is large enough that the eddy effect would be negligible were they not offset in position. It is also preferred that the arrays 61–63 be closely spaced within drum interior 28 so that the energy induced in conductive components of the particulate material is not lost as the components are advanced past magnetic assembly 60.

In operation then, particulate material which is introduced onto drum sidewall 26 is subjected to the high frequency magnetic field generated by magnetic arrays 61–63 through drum sidewall 26. As conductive components of the particulate material initially encounter this magnetic field, eddy-currents are induced in these conductive components which polarizes them. As the conductive components continue alongside drum sidewall 26, the magnetic field reverses direction which results in a repulsion force being exerted on the conductive components, which repulsion force acts to cast these components in a downstream direction where they may be collected in a discharge bin. Of course, non-conductive components of the particulate material are unaffected by the oscillating, high frequency magnetic field. Thus, these components continue alongside drum sidewall 26 and are simply deposited, due to the effect of gravity, into a nearer collection bin.

FIG. 11(*c*) illustrates an alternative orientation for magnetic arrays 61–63 within the drum interior. Here it may be seen that the middle magnetic array 62 is spaced radially inwardly from the drum axis relative to magnetic array 61 and 63. Again, magnetic array 62 counter-rotates relative to magnetic arrays 61 and 63. It has been found that this orientation for the magnetic arrays is useful for those applications in which the particulate material consists of fine particles with small differences in electrical conductivity.

Figure 12:
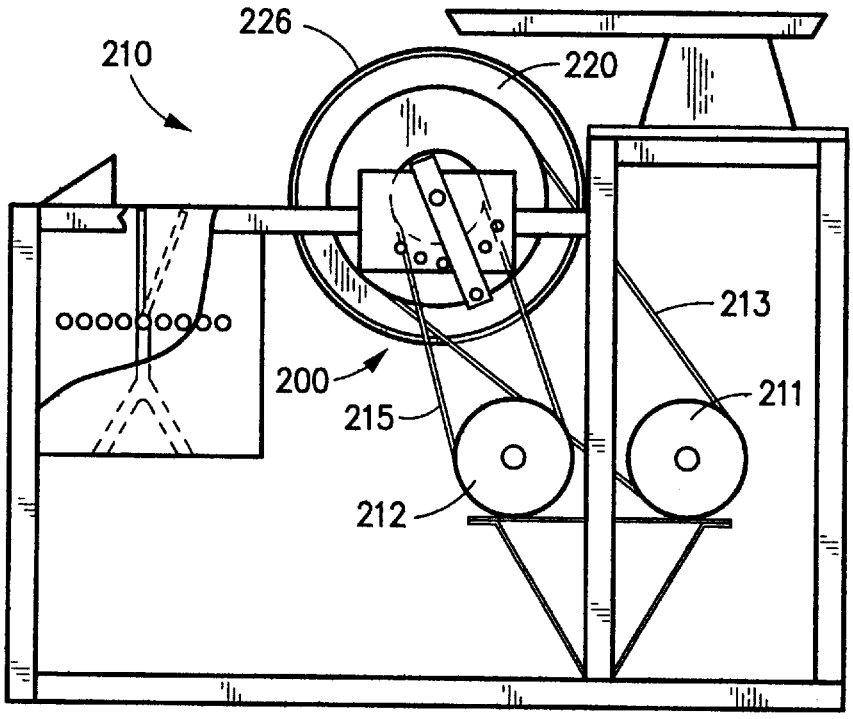
FIG. 12 is a side view in elevation of a material separator according to a second exemplary embodiment of the present invention.
Figure 13:
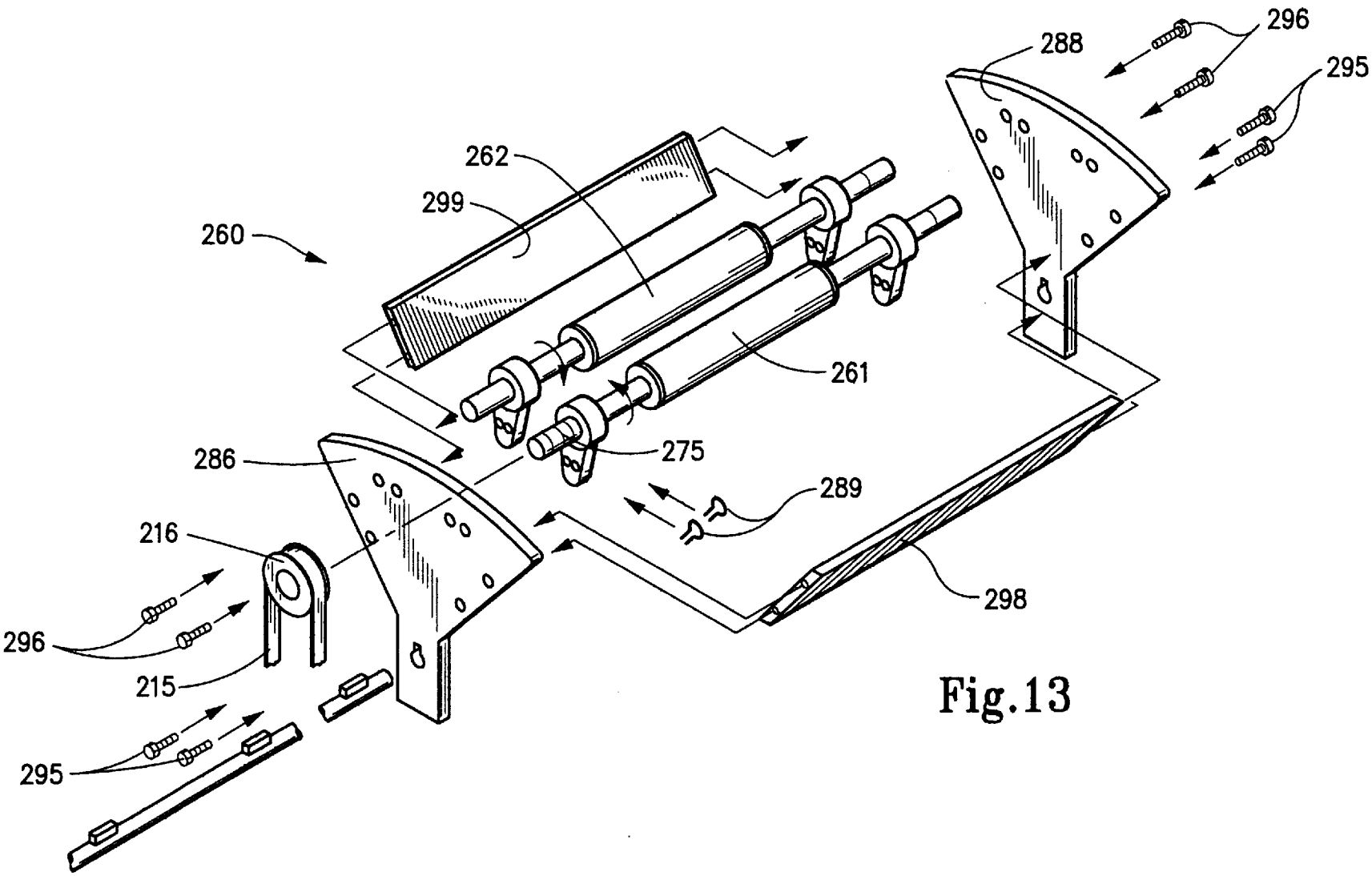
FIG. 13 is an exploded perspective view showing an exemplary construction for the magnetic assembly according to the second exemplary embodiment of the present invention.

Finally, FIGS. 12 and 13 show a second exemplary embodiment for the material separator of the present invention. Here, it may be seen that material separator 210 is constructed similarly to material separator 10 discussed above in FIG. 1 with reference to the first exemplary embodiment, with a few notable exceptions. Unlike the first embodiment, the drive system 200 for material separator 210 includes two drive motors as opposed to one. A first drive motor 211 aces through a first drive belt 213 to impart rotation to drum 220. A second drive motor 212 operates through a second drive belt 215 to rotate the internal magnetic arrays about their respective array axes to induce the oscillating magnetic field. For material separator 210, it is preferred that the drum's sidewall 226 have a diameter of approximately 24" and that a ⅓ HP motor be used to drive drum 220. It is also preferred that second drive motor 212 be a 5 HP AC motor so that there will be sufficient start-up torque to drive the magnetic arrays without drawing too much amperage.

In FIG. 13, it may be seen that the construction of the magnetic assembly 260 of material separator 210 is somewhat simplified compared to magnetic assembly 60 discussed herein previously with reference to FIG. 6. Here, only two magnetic arrays 261 and 262 are used, which are preferably in the form of cylindrical rolls as discussed above. It has been found that with a smaller shell diameter of 24 inches that three magnetic arrays, or rolls, cover too much arc and thus the energy imparted by the first roll is lost by the time the particulate passes over the third. Accordingly, reliable results are achievable with only two magnetic arrays as opposed to three. Again, it is preferable that magnetic arrays 261 and 262 counterrotate with respect to one another to generate the fluctuating magnetic field.

As may also be seen in FIG. 13, the entire interlocking gear assembly to drive the magnetic arrays has been eliminated. Instead, only first magnetic array 261 is rotated by second drive motor 212 which is interconnected to pulley 216 by second drive belt 215. Pulley 216 is fixedly mounted on first trunnion axle 275 associated with first magnetic array 261 and is retained thereon by C-clips 289. Rotation of first magnetic array 261 acts to impart a corresponding rotation to second magnetic array 262 via the interaction of their magnetic fields. Of course, with this construction, it is also no longer required that the rolls be positioned 45° out of phase with respect to one another.

Finally, and as may also be seen in FIG. 13, spacers 298 and 299 are in the form of rectangular plates, as opposed to rods, which provides additional surface area to reduce the chance of slippage of support plates 286 and 288 during operation. Screws 295, 296 may be used to mount spacers 298 and 299 in between support plates 286 and 288.

With the foregoing in mind, it should be readily appreciated by one of ordinary skill in this field that alterative constructions for the magnetic assemblies of the present invention could be readily employed depending on the particular application at hand. For example, the number of magnetic arrays, or rolls, which are selected depends at least partly on the diameter of the drum's shell, with a larger diameter shell requiring a larger number of rolls. Moreover, the ability to rotate the rolls via an interlocking gear assembly or via magnetic induction, as well as the provision of one or two drive motors, would also be dictated by the particular application at hand.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A material separator adapted to separate non-magnetic particulate material into different components having differing electrical conductivities, comprising:

(a) a support frame;

(b) a drum rotatably journaled with respect to said support frame about a longitudinally extending drum axis, said drum having a drum sidewall formed as a cylindrical shell and having a drum interior;

(c) a magnetic assembly disposed in the drum interior and including a plurality of longitudinally extending magnetic arrays each rotatably journaled on a respective longitudinally extending array axis that is radially spaced from the drum axis with said array axes angularly spaced from one another, each of said magnetic arrays including opposite magnetic poles located along a surface of rotation such that, as each of said magnetic arrays is rotated, opposite magnetic poles are sequentially advanced in closely spaced relation alongside said drum sidewall thereby to induce an oscillating magnetic field through said drum sidewall; and (d) a drive system operative to rotate each of said magnetic arrays about its respective array axis to induce said oscillating magnetic field, said drive system further operative to rotate said drum about the drum axis so that as said drum sidewall moves past said magnetic assembly, particulate material placed on an outer surface of said drum sidewall is subjected to the oscillating magnetic field whereby components of said particulate material having different electrical conductivities will be discharged off of said drum with differing discharge trajectories.

2. A material separator according to claim 1 wherein each of said magnetic arrays is formed as a roll including a plurality of magnetic bars.

3. A material separator according to claim 2 wherein the magnetic bars associated with each said roll are arranged in a plurality of longitudinally extending columns and are angularly spaced apart from one another relative to the respective array axis.

4. A material separator according to claim 3 wherein said columns are equiangularly spaced apart from one another relative to the respective array axis.

5. A material separator according to claim 4 wherein said columns are separated from one another by an magnetically insulative spacer that is sized and adapted to be inserted into said cylindrical casing.

6. A material separator according to claim 4 wherein said the magnet bars in each of said columns have north and south poles aligned along a radial direction relative to the respective array axis.

7. A material separator according to claim 4 wherein adjacent ones of columns having opposite poles located radially inwardly.

8. A material separator according to claim 4 wherein each of said columns is formed by a plurality of discrete magnets arranged stack-wise in a longitudinal direction.

9. A material separator according to claim 2 wherein a middle one of said roils is operative to counterrotate with respect to outer ones of said rolls.

10. A material separator according to claim 9 wherein said middle one of said rolls is spaced radially inwardly from the drum axis relative to the outer ones of said rolls.

11. A material separator according to claim 2 wherein each said roil is positioned at a common radial distance from the drum axis and is equiangularly spaced apart relative to the drum axis from an adjacent said roil.

12. A material separator according to claim 2 wherein said roll includes an outer cylindrical casing constructed of a non-magnetic material, said magnetic bars housed within said casing.

13. A material separator according to claim 2 including a trunnion axle associated with each of said rolls and disposed along the respective roll axis, said drive system including a plurality of interlocking gears, there being at least one of said gears associated with each of said rolls and journaled about the respective trunnion axle so that said rolls are coupled for rotation by said interlocking gears.

14. A material separator according to claim 1 wherein said drive system is operative to rotate said magnetic arrays at a greater rotational speed than said drum.

15. A material separator according to claim 14 wherein said rotational speed is within a range of 2,000 to 4,000 revolutions per minute.

16. A material separator according to claim 15 wherein said drive system is operative to rotate said drum within a range of 30 to 200 revolutions per minute.

17. A material separator according to claim 1 including an axle member disposed along the drum axis, said magnetic assembly supported relative to said axle member by an opposed pair of longitudinally spaced apart support plates.

18. A material separator according to claim 17 including a key structure operative to fixedly support said magnetic assembly relative to said axle member.

19. A material separator according to claim 17 wherein said support plates are arcuately configured and extend radially outwardly from said axle member, said magnetic arrays mounted between said support plates by a pair of flanged bearings.

20. A material separator according to claim 1 wherein said support frame is formed to include a collection bin that is positioned to receive said components as they are discharged.

21. A material separator according to claim 20 wherein said collection bin is separated into a plurality of collection regions by a selectively positionable partition wall that is mounted to said support frame.

22. A material separator according to claim 1 wherein said drive system includes a first drive motor operative to rotate said magnetic arrays and a second drive motor operative to rotate said drum.

23. A material separator according to claim 22 wherein said magnetic assembly consists of two said magnetic arrays, said two magnetic arrays magnetically coupled whereby mechanical rotation of a first one of said magnetic arrays by said first drive motor results in a corresponding counter-rotation being magnetically imparted to a second one of said magnetic arrays.

24. A material separator according to claim 1 wherein said drive system is operative to rotate said magnetic arrays at a common rotational speed and wherein the oscillating magnetic fields induced by said magnetic arrays are approximately 45 degrees out of phase.

25. A material separator according to claim 1 wherein the outer surface of said shell has a medial portion with a reduced circumference with respect to a remainder of said outer surface thereby to form a central working region for receiving the particulate material.

26. A material separator adapted to separate non-magnetic particulate material into different components having differing electrical conductivities, comprising:

(a) a support frame;

(b) a drum rotatably journaled with respect to said support frame about a longitudinally extending central drum axle which projects outwardly from said drum, said drum having a drum sidewall formed as a cylindrical shell out of a selected material and having a drum interior;

(c) a magnetic assembly disposed in the drum interior proximately to said drum sidewall and supported by said drum axle, said magnetic assembly operative to product a fluctuating magnetic field in a region therearound and being selectively and rotatably adjustable in position relative to said drum axis so that said magnetic field may be shifted to a desired location within the interior;

(d) a drive system interconnected to said magnetic assembly and operative upon actuation to cause said magnetic assembly to produce said fluctuating magnetic field in a region proximately to said drum sidewall, said drive system further operative to rotate said drum about the drum axis so that as said drum sidewall moves past said magnetic assembly particulate material placed on an outer surface of said drum sidewall is subjected to the fluctuating magnetic field whereby components of said particulate material having different conductivities will be discharged off of said drum with differing discharge trajectories; and (e) a handle member connected to a longitudinal end of said drum axle, said handle member being selectively movable with respect to said support frame thereby to reposition said magnetic assembly at discrete orientations within the drum interior.

27. A material separate according to claim 26 wherein said support frame includes a bracket mounted thereto, said bracket including a plurality of bores formed therethrough, said handle member constructed to engage selected ones of said bores thereby to reposition said magnetic assembly within the drum interior.

28. A method of separating non-magnetic particulate material into different components having differing electrical conductivities, comprising the steps of:

(a) rotating a drum about a longitudinally extending drum axis, said drum having a drum sidewall;

(b) counterrotating at least two of a plurality of magnetic arrays within an interior of said drum in a region proximate to said drum sidewall, thereby to produce a fluctuating magnetic field which penetrates said sidewall;

(c) depositing said particulate material onto said drum sidewall so that said particulate material is subjected to the fluctuating magnetic field whereby components of said particulate material having different conductivities will be discharged off of said drum with differing discharge trajectories; and (d) collecting said components at separate discharge locations.

29. In an apparatus adapted for use in separating non-magnetic material into components according to different conductivities wherein a drum has a sidewall formed as a cylindrical shell which is journaled for rotation relative to a support frame about a longitudinally extending drum axis with the drum having a drum Interior, an improvement comprising a magnetic roll assembly disposed in the drum interior proximate to said drum sidewall, said magnetic roll assembly including a plurality of longitudinally extending rolls each rotatably journaled about a respective roll axis, said rolls being angularly spaced apart from one another relative to the drum axis and each of said rolls including a magnetic array formed by a plurality of permanent magnets, said magnetic roll assembly operative to produce a fluctuating magnetic field and positioned such that particulate material placed on an outer surface of said drum sidewall will be subjected to the fluctuating magnetic field from said magnetic roll assembly as said sidewall is advanced past said magnetic roll assembly.

30. The improvement of claim 29 wherein the permanent magnets associated with each of said rolls are arranged in a plurality of longitudinally extending columns which are equiangularly spaced apart from one another relative to their associated roll axis.

31. The improvement of claim 30 wherein said columns are separated from one another by an insulative spacer.

32. The improvement of claim 31 wherein said columns have north and south poles aligned along a radial direction with adjacent ones of columns having opposite poles located radially inwardly.

33. The improvement of claim 32 wherein each of said columns is formed by a plurality of discrete magnets arranged stack-wise in a longitudinal direction.

34. The improvement of claim 30 wherein each of said rolls includes an outer casing constructed of a non-magnetic material and wherein said columns are disposed within said casing at a common radial distance from the roll axis.

35. The improvement of claim 29 wherein said magnetic roll assembly includes three said rolls with said rolls being equiangularly spaced apart from one another relative to the drum axis.

36. The improvement of claim 29 wherein said magnetic roll assembly consist of two said rolls which are operative to counter-rotate with respect to one another.

37. A method of separating non-magnetic particulate material into different components having differing electrical conductivities, comprising:

(a) rotating a drum about a longitudinally extending drum axis, said drum having a drum sidewall;

(b) rotating a plurality of magnetic arrays, each formed as a magnetic roll, within an interior of said drum in a region proximate to said drum sidewall, thereby to produce a fluctuating magnetic filed which penetrates said sidewall;

(c) depositing said particulate material onto said drum sidewall so that said particulate material is subjected to the fluctuating magnetic field whereby components of said particulate material having different conductivities will be discharged off of said drum with differing discharge trajectories; and (d) collecting said components at separate discharge locations.

38. The method according to claim 37 wherein at least two of said rolls are counterrotated with respect to one another.

39. The method according to claim 37 wherein said rolls are rotated at a greater rotational speed than said drum.

* * * * *